US007857647B2

(12) United States Patent
Bracci et al.

(10) Patent No.: US 7,857,647 B2
(45) Date of Patent: Dec. 28, 2010

(54) WEATHER RESISTANT ELECTRICAL CONNECTOR

(75) Inventors: Thomas W. Bracci, Trumbull, CT (US); Thomas J. Vigorito, Black Rock, CT (US)

(73) Assignee: Hubbell Incorporated, Shelton, CT (US)

( * ) Notice: Subject to any disclaimer, the term of this patent is extended or adjusted under 35 U.S.C. 154(b) by 296 days.

(21) Appl. No.: 12/099,903

(22) Filed: Apr. 9, 2008

(65) Prior Publication Data

US 2009/0258522 A1 Oct. 15, 2009

(51) Int. Cl.
*H01R 13/52* (2006.01)

(52) U.S. Cl. ..... 439/282; 439/587; 439/274; 439/462

(58) Field of Classification Search ..... 439/282, 439/281, 587, 589, 274–275, 278, 462
See application file for complete search history.

(56) References Cited

U.S. PATENT DOCUMENTS

| | | | | |
|---|---|---|---|---|
| 2,626,299 | A | 1/1953 | Richards | |
| 2,639,313 | A | 5/1953 | Street, Jr. | |
| 2,881,406 | A | 4/1959 | Arson | |
| 2,962,688 | A | 11/1960 | Werner | |
| 3,020,516 | A | 2/1962 | Despard | |
| 3,046,512 | A | 7/1962 | Remke et al. | |
| 3,120,987 | A | 2/1964 | Degnan et al. | |
| 3,452,321 | A | 6/1969 | Carissimi et al. | |
| 3,601,761 | A * | 8/1971 | Harris | 439/275 |
| 3,665,368 | A | 5/1972 | Ellis | |
| 3,704,034 | A | 11/1972 | Shire et al. | |
| 3,744,008 | A * | 7/1973 | Castellani | 248/56 |
| 3,880,487 | A | 4/1975 | Goodman et al. | |
| 4,684,192 | A | 8/1987 | Long et al. | |
| 4,795,360 | A | 1/1989 | Newman et al. | |
| D322,954 | S | 1/1992 | Avramovich | |
| 5,098,310 | A | 3/1992 | Avramovich et al. | |
| D334,172 | S | 3/1993 | Wilcoxon | |
| 5,208,427 | A * | 5/1993 | Couto et al. | 174/653 |
| 5,405,172 | A | 4/1995 | Mullen, Jr. | |
| 5,641,310 | A | 6/1997 | Tiberio, Jr. | |
| 5,743,759 | A | 4/1998 | Pudims et al. | |
| 5,857,865 | A | 1/1999 | Shimirak et al. | |

(Continued)

OTHER PUBLICATIONS

PermaTite 2, Ericson Manufacturing Company brochure, 2004.

*Primary Examiner*—Xuong M Chung Trans
(74) *Attorney, Agent, or Firm*—Garrett V. Davis; Mark S. Bicks; Alfred N. Goodman

(57) ABSTRACT

An electrical connector is provided including a housing supporting an electrical device and for receiving an electrical cord or cable. A cap having internal threads and an axial passage for receiving the electrical cord and clamping the electrical cord to the housing to form a waterproof connection. The cap includes a conical shaped seal member for forming a waterproof seal with the outer surface of the electrical cord. A conical shaped bushing is received in a frustoconical shaped bore of the housing and is axially and radially compressed by the threaded cap onto the housing. The bushing has an axial bore for receiving the electrical cable and an outer surface with at least one annular recess to facilitate the axial and radial compression of the bushing. The bottom end of the cap has a chamfered edge which mates with a frustoconical shaped outer surface of the housing to form a waterproof seal.

34 Claims, 4 Drawing Sheets

U.S. PATENT DOCUMENTS

| | | | |
|---|---|---|---|
| 5,863,221 | A | 1/1999 | Castaldo |
| 6,017,243 | A | 1/2000 | Castaldo |
| 6,517,373 | B2 | 2/2003 | Finke et al. |
| 6,558,180 | B2 | 5/2003 | Nishimoto |
| 6,739,900 | B2 | 5/2004 | Mortun et al. |
| 7,097,500 | B2 | 8/2006 | Montena |
| 7,134,894 | B2 | 11/2006 | Murphy et al. |
| 7,175,459 | B2 | 2/2007 | Milner et al. |

* cited by examiner

WEATHER RESISTANT ELECTRICAL CONNECTOR

FIELD OF THE INVENTION

The present invention is directed to a weather resistant electrical connector. The invention is particularly directed to an electrical connector made from an elastomeric material having sealing surfaces between the components of the connector to prevent water and debris from entering the connector.

BACKGROUND OF THE INVENTION

Electrical devices and particularly electrical connectors are known in the art. Electrical connectors are commonly provided for connecting an electrical cord or cable to a plug or receptacle.

Many of the known electrical connectors are provided with a strain relief mechanism to prevent the cord from separating from the electrical plug or receptacle and reducing the incidence of electrical shock. The strain relief mechanisms typically do not provide adequate water resistance for wet locations.

One form of strain relief connection uses a deformable bushing that is captured between two tapered surfaces. Other devices capture a bushing between a tapered wall and a straight wall. A nut or cap is typically threaded onto the device to apply an axial compression to the bushing to grip the cord and form a seal. This type of compression does not always form an adequate amount of strain relief to couple the cord to the connector, or under tightening of the member, which can result in inadequate amount of strain relief.

One prior device has a cord grip with a deformable bushing and grip member. The grip member is a circular member to provide a gripping edge for the cord insulation. This type of device has the disadvantage of enabling over tightening of the member which can damage the cord or deform the connector.

Other prior devices include a body and a nut threaded onto the end of the body. A conical shaped bushing is inserted into the conical bore of the body. A gripping member having a plurality of fingers is positioned around the cord and next to the bushing. The nut is tightened onto the body to compress the bushing and deform the fingers of the gripping member into contact with the cord. The tightening the nut causes the deformable fingers to grip the outer surface of the cord. One example of this type of device is disclosed in U.S. Pat. No. 6,017,243 to Castaldo.

Another example of a cord grip assembly is disclosed in U.S. Pat. No. 3,601,761 to Harris. The device includes a body with a passage for the cord and nut threaded onto the body. A pair of wedge-shaped members is inserted between the opening in the body and the cord. The nut is tightened to force the wedge-shaped members into contact with the cord to grip the cord.

Another example of a cord grip for an electrical device having a bushing inserted into a conical bore of a housing is disclosed in U.S. Pat. No. 3,046,512 to Remke. A nut is tightened onto the housing to compress and wedge the bushing against the cord.

Other prior devices having various coupling designs for coupling two connectors together are disclosed in U.S. Pat. Nos. 7,134,894 to Murphy, 7,097,500 to Montena, 6,558,180 to Nishimotu, 5,857,865 to Shimirak, and 4,795,380 to Newman.

While the prior devices have generally preformed their intended purpose, there is a continuing need in the industry for improved assemblies for connecting an electrical cord to an electrical connector.

SUMMARY OF THE INVENTION

The present invention is directed to a weatherproof or weather resistant electrical connector capable of forming a seal between two connectors. The connector of the invention includes inner seals to prevent water and debris from entering the body of the connector.

The invention relates to an electrical device such as an electrical connector having a strain-relief coupling. The strain-relief coupling provides a water resistant or waterproof coupling to inhibit water and debris from entering the electrical connector.

The electrical connector of the invention has a housing for supporting an electrical device such as an electrical plug or receptacle. A cap is threaded onto the end of the housing to attach an electrical cord or cable to the housing in a water tight manner to prevent water and debris from entering the housing through the cord connection with the housing. In one embodiment the cap is provided with a seal to form a seal between the cap and the outer surface of the cord. An inner seal such a bushing is axially compressible to form a cord grip for coupling the cord to the housing and forming a seal between the cord and the housing.

Accordingly, one aspect of the invention is to provide an electrical connector having a bushing that is capable of forming a seal between a cap and the body of the connector. In one embodiment of the invention the bushing is axially and radially compressible to form a seal by applying an axial force by threading the cap onto the housing.

Another aspect of the invention is to provide an electrical connector having a frustoconical shaped bushing having at least one annular recess to enable axial and radial compression of the bushing when an axial force is applied.

Another aspect of the invention is to provide an electrical connector having a rigid body for supporting an electrical device such as an electrical outlet or connector and having an outer sheath formed on the outer surface of the body. The sheath is molded directly on the body and adhered to the body. The outer sheath is formed from an elastic, flexible material to enable forming a water resistant seal between the body and the sheath and a cap. The sheath is typically formed form an elastomeric plastic material.

The electrical connector of the invention has a threaded cap which is coupled to a body. The cap has a recess at a first end for receiving a seal having an axial passage to receive an electrical cord. The seal is seated in the recess of the cap. The seal includes a top portion around the axial passage that is sufficiently thin and flexible to form a seal around the cord when the cord is passed through the axial passage. In one embodiment the top portion of the seal flexes axially outward along the axial dimension of the cord to form a sealing surface and prevent water and debris from entering the cap between the seal and the cord.

These and other aspects of the invention are basically attained by providing a strained relieved cord grip assembly, comprising: a body having a first end, a second end and an axial passage extending between the first end and the second end. The axial passage defines a frustoconical axial bore at the first end. A compressible bushing is adapted to be received in the axial bore. The bushing has a frustoconical outer surface with a shape complementing the frustoconical shape of the axial bore. The outer surface of the bushing has at least one annular groove. A cap is coupled to the first end of the body for axially compressing the bushing and compressing the annular groove to form a compression seal between the bushing and the body.

The various aspects of the invention are also attained by providing an electrical connector having a strained relief cord grip, comprising: a body having a frustoconical bore. A compressible bushing is received in the bore. The bushing has an outer surface with at least one annular groove. A cap is provided for coupling to the first end of the body for axially compressing the bushing to form a seal between the cap and body. The cap has an axial passage extending between a first end and a second end. The first end has a recess facing axially outward. A seal member is received in the recess of the cap. The seal member has an outer surface for mating with the recess of the cap. An axial passage is provided for receiving a cord and a flexible frustoconical seal extending axially outward from the cap. The flexible seal has an axial opening for receiving the cord and an inner edge defining the opening. The inner edge deflects axially outward to form a seal on the cord.

The aspects of the invention are yet further attained by providing an electrical connector comprising: a body formed from a rigid material and having a first end, a second end and an axial passage extending between the first end having a threaded coupling and a second end supporting an electrical device, and a frustoconical collar between the threaded coupling and the second end. An outer sheath is formed from a resilient plastic material on the body. The outer sheath has a first end overlying the collar and a second end. A compressible bushing is adapted to be received in the axial passage of the first end of the body. The bushing has an axial passage for receiving an electrical cord. A cap has an axial passage for receiving the electrical cord and internal threads for coupling with the body. The cap has a first end and a second end. The second end has a frustoconical inner edge for mating with the outer sheath to define a seal between the cap and the sheath.

These and other aspects and salient features of the invention will become apparent from the following detailed description of the invention, which taken in conjunction with the annexed drawings, disclose various embodiments of the invention.

BRIEF DESCRIPTION OF THE DRAWINGS

The following is a brief description of the drawings, in which.

DETAILED DESCRIPTION OF THE INVENTION

The present invention is directed to an electrical connector assembly and an electrical connector. The invention is particularly directed to an electrical connector for forming a weatherproof connection between an electrical cord and the electrical components of the connector.

Figure 1:
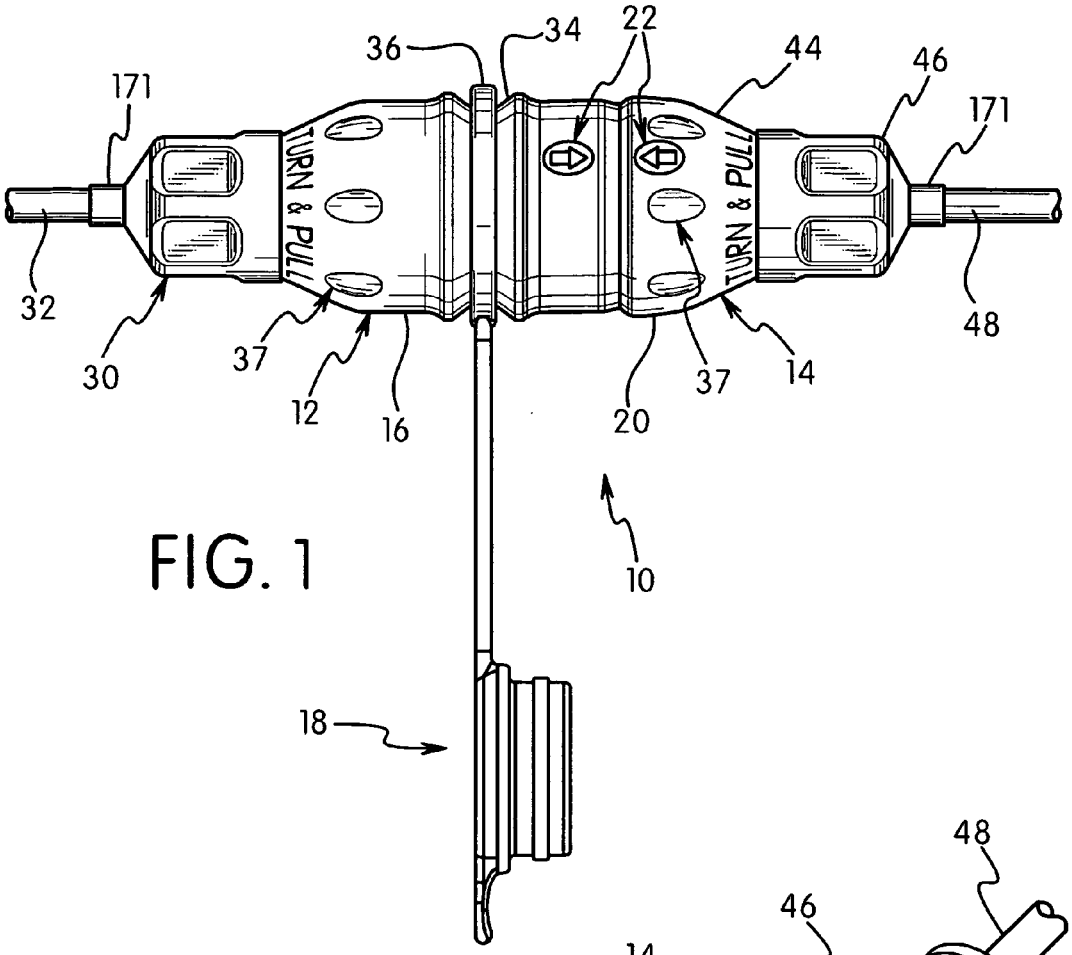
FIG. 1 is an elevational side view of the assembled electrical connector according to an embodiment of the invention.
Figure 2:
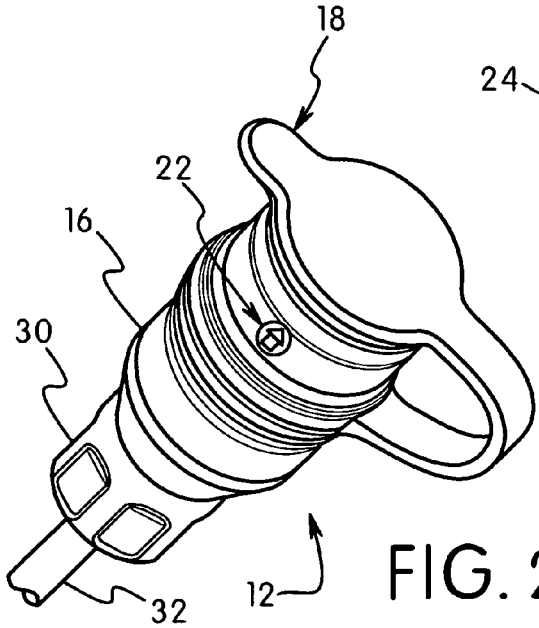
FIG. 2 is a perspective view of the one electrical connector of FIG. 1 and showing the cover attached to the connector.
Figure 3:
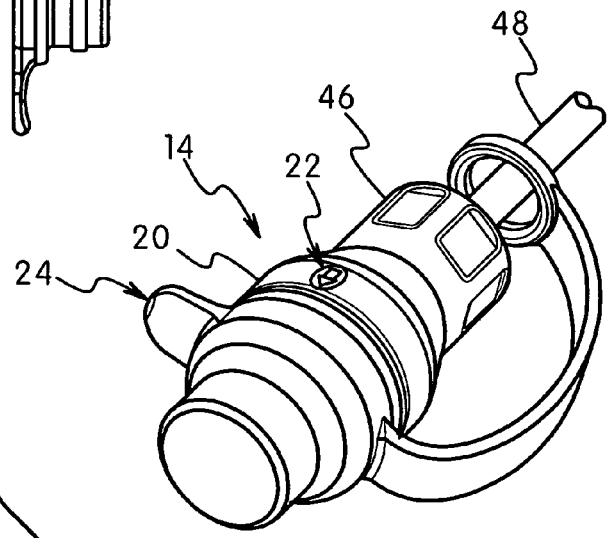
FIG. 3 is a perspective view of an electrical connector of FIG. 1 and showing the cover attached to the connector.

Referring to FIGS. 1-6, the electrical connector assembly 10 includes an electrical connector 12 and an electrical connector 14 coupled together. In the embodiment illustrated, electrical connector 12 includes a housing 16 which supports an electrical receptacle. A protective cap 18 is coupled to housing 16 which can be attached to the open end of housing 16 to protect the electrical plug as shown in FIG. 2. Electrical connector 14 includes a housing 20 which couples to housing 16 of electrical connector 12 as shown in FIGS. 1 and 3. In the embodiment illustrated, electrical connector 14 includes a plurality of prongs for mating with the electrical receptacle of connector 12.

As shown in FIG. 1, electrical connectors 12 and 14 include marks 22 in the form of alignment arrows to align the prongs of connector 14 with connector 12. As shown in FIG. 3, electrical connector 14 can include a protective cap 24 which snaps onto the end of electrical connector 14 to enclose the prongs 42 and protect the connector from water and debris.

Figure 6:
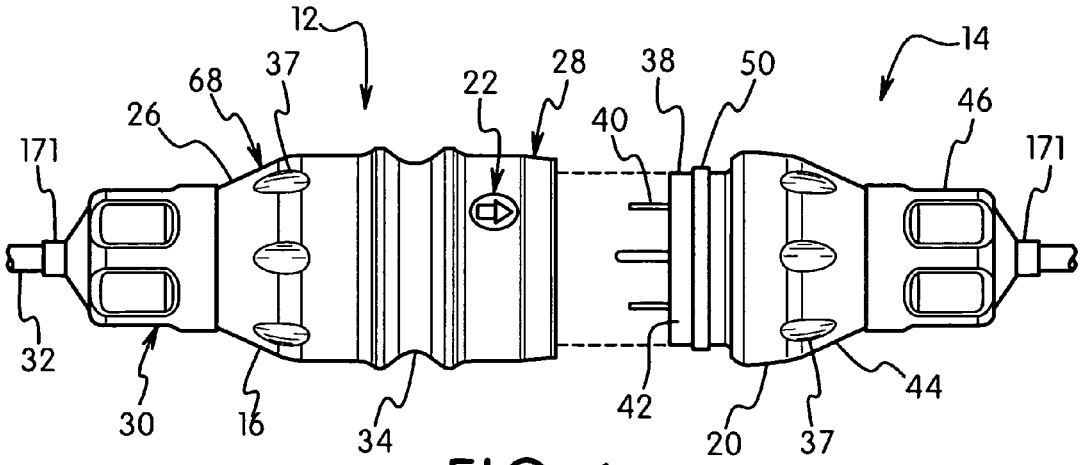
FIG. 6 is a side view showing the connectors of FIG. 1 separated from each other.

As shown in FIG. 6, electrical connector 12 has a cylindrical shaped housing 16 with a first end 26 and a second end 28. A cap 30 is coupled to the first end 26 of housing 16 to attach an electrical cord 32 to electrical connector 12. The outer surface of housings 16 and 20 have a generally smooth surface to prevent dirt and water from collecting. As shown in FIG. 6, the outer surface of housing 16 is provided with an annular recess 34 for receiving the elastic ring 36 of cap 18 to tether the cap 18 to the electrical connector 12. In the illustrated embodiment, the outer surface connectors 12 and 14 are provided with shallow grooves 37 for gripping by the user.

Figure 4:
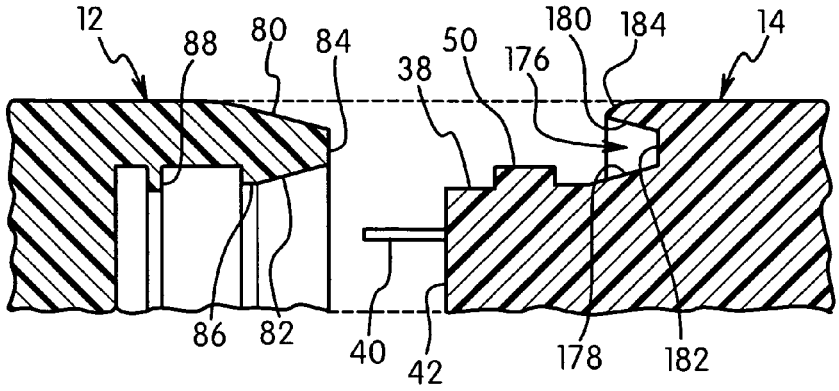
FIG. 4 is a partial side cross sectional view of the coupling of the electrical connector of FIG. 1 showing the two connectors before coupling.
Figure 5:
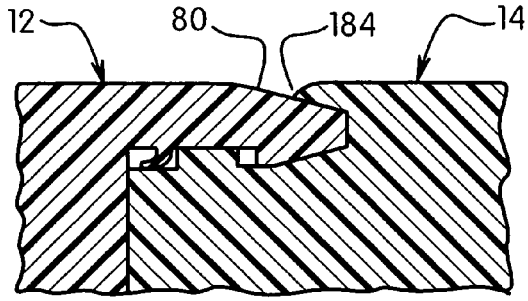
FIG. 5 is a partial side view in cross-section of the electrical connector showing the two connectors coupled together.

The electrical connector 14 as shown in FIG. 6 includes housing 20 with an axially extending body 38. The prongs 40 extend axially from the body 38 for coupling with the electrical receptacle of electrical connector 12. The body 38 has a substantially cylindrical shape with an outer end 42. Housing 20 of electrical connector 14 has a frustoconical shaped first end 44 to provide a smooth outer surface to prevent water and dirt from collecting. A cap 46 is threaded onto a threaded end of housing 20 for connecting an electrical cord 48 to housing 20. The axially extending body 38 includes an annular rib 50 for coupling with electrical connector 12 and forming a waterproof seal as shown in FIGS. 4 and 5.

Figure 7:
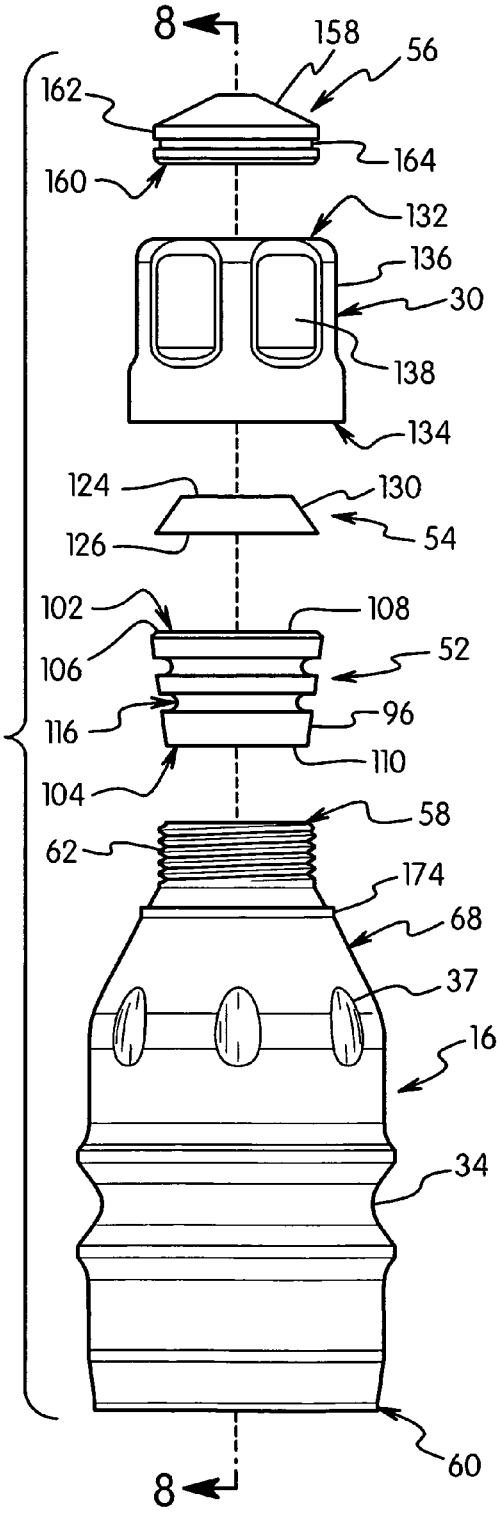
FIG. 7 is an exploded side view of the electrical connector in an embodiment of the invention.
Figure 8:
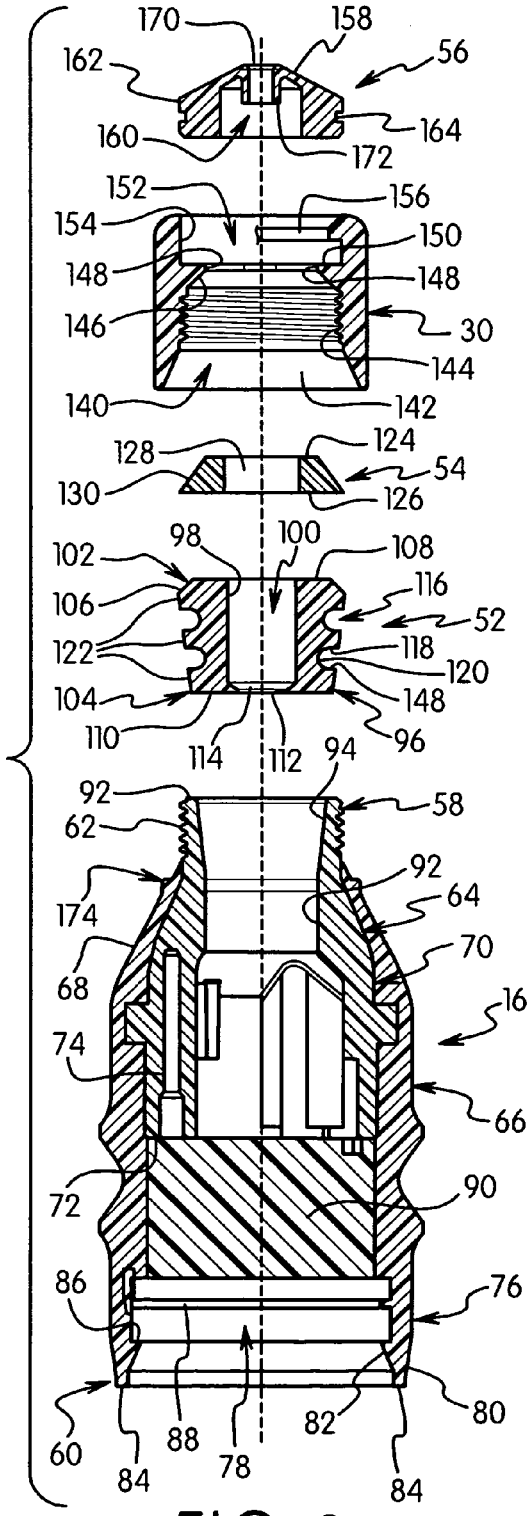
FIG. 8 is an exploded side view in cross section of the electrical connector of FIG. 7.

Referring to FIGS. 7 and 8, electrical connector 12 is shown as including housing 16 and cap 30 for coupling to housing 16. A bushing 52 and a compression washer 54 are positioned between housing 16 and cap 30. A seal 56 is coupled to the end of cap 30 as discussed hereinafter in further detail. The construction of electrical connector 14 is substantially the same as electrical connector 12. In the following discussion, the invention will be described in connection with connector 12, although it will be understood that a similar structure is provided for electrical connector 14.

As shown in FIG. 7, housing 16 has a substantially cylindrical shape with a first end 58 and a second end 60. First end 58 includes a threaded coupling 62 for mating with cap 30. Second end 60 includes an open end portion for accessing the electrical receptacle. The outer surface of housing 16 has a substantially smooth surface to shed water and dirt.

Referring to FIG. 8, housing 16 in one embodiment of the invention is formed from a body 64 and an outer sheath 66. Body 64 is typically made from a rigid material such as a rigid plastic. Body 64 defines the first end 58 of housing 16 and includes the threaded coupling 62. The threaded coupling 62 is defined by an annular cylindrical sleeve extending axially from body 64. Body 64 includes a frustoconical shaped collar 68 and a plurality of recessed portions 70 on the outer surface. Body 64 includes a second end 72 forming a cylindrical sleeve portion 74.

In an embodiment shown in FIG. 8, sheath 66 is molded directly onto body 64 and is secured in a permanent manner. Sheath 66 extends from the base of collar 68 and overlies body 64 to define the outer surface of housing 16. Sheath 66 is preferably formed from a flexible elastomeric polymer or resin for forming a water resistant seal with the connector 14. The outer sheath 66 also provides impact resistance to the connector to protect the rigid body 64.

Sheath 66 forms an annular sleeve 76 extending axially from body 64. As shown in FIG. 8, body 64 and sheath 66 of housing 16 include an axial passage extending from the first end to the second end.

Sleeve 76 of sheath 66 defines the second axial end 60 of housing 16. As shown in FIG. 8, the sleeve 76 has a chamfered outer sealing surface 80 and a chamfered inner sealing surface 82 which converge to define the second end 60. In the embodiment illustrated, an annular axial sealing surface 84 extends between the inner chamfered surface 82 and the chamfered outer surface 80. Axial face 84 as shown extends in a plane perpendicular to the axis of housing 16. Inner chamfered surface 82 defines a lip 86 for coupling with the rib 50 of connector 14. Lip 86 lies in a plane substantially perpendicular to the axis of the housing 16. An annular flexible rib 88 is axially spaced from lip 86 to form a seal when coupled to connector 14.

Body 64 in the embodiment illustrated includes an internal cavity for receiving wiring and electrical connections for the electrical receptacle 90. The electrical receptacle 90 is coupled directly to the axial end of body 64.

As shown in FIG. 8, axial passage 78 of body 64 includes a cylindrical portion 92 and a frustoconical bore 94. As shown in FIG. 8, frustoconical bore 94 opens outwardly toward the first axial end 58 of housing 16.

Bushing 52 has an annular shape with a frustoconical outer surface 96 and an inner surface 98 forming an axial passage 100 through bushing 52 from a first end 102 to a second end 104. Axial passage 100 has a substantially cylindrical shape to conform to the shape and dimensional size of electrical cords for this bushing 52 size range. The frustoconical outer surface 96 of bushing 52 has a chamfered edge 106 adjacent first end 102. First end 102 has a substantially flat planar top surface 108 in the illustrated embodiment. Second end 104 has a planar bottom surface 110 substantially parallel to top surface 108. Bottom surface 110 includes an inwardly extending annular flange 112 at the second end 104. In the embodiment illustrated, flange 112 has a chamfered inner surface 114.

As shown in FIGS. 7 and 8, the outer frustoconical surface 96 of bushing 52 has a plurality of annular recesses 116 which define annular grooves. The annular recesses 116 are spaced apart along the axial length of bushing 52. As shown, annular recesses 116 have substantially parallel side walls 118 and a concave bottom surface 120 to define a substantially U-shape. The annular recesses define substantially flat sealing surfaces 122 between the adjacent annular recesses 116. Although two annular recesses 116 are shown in the figures, the actual number of annular recesses can vary depending on the dimension of the bushing and connector and the compression force applied to the bushing.

Compression washer 54 has a top surface 124, a bottom surface 126, and an axial passage 128. Washer 54 has a chamfered side edge 130. The bottom surface 126 to the top surface 108 of bushing 52. In one embodiment, the compression washer has a diagonal slot 129 to form a split ring.

Cap 30 as shown in FIGS. 7 and 8 has a substantially cylindrical shape with a top end 132, a bottom end 134 and an outer side surface 136. The outer surface 136 of cap 30 includes recesses 138 for enabling gripping by the user.

Cap 30 includes an axial passage 140 extending between top end 132 and bottom end 134. Bottom end 134 has a chamfered inner edge 142. The chamfered inner edge 142 has an incline corresponding to the incline of the collar 68 for sealing with the collar. Axial passage 140 includes an inner surface with threads 144 for coupling with the threaded coupling 62 of housing 16. At an upper end of the threads 144 is a chamfered surface 146 forming an inwardly extending annular flange 148. Flange 148 has a substantially flat top surface 150 spaced from the top end 132 and defining a recess 152 at the top end 132. As shown in FIG. 8, the recess 152 is defined by a cylindrical side wall 154 and includes an inwardly extending to tab 156.

The seal 56 has a substantially conical shape to form a cone seal having a frustoconical top surface 158, a flat bottom surface 160, and a cylindrical outer surface 162. The outer surface 162 is provided with an annular recess 164 for mating with the tab 156.

As shown in FIG. 8, seal 56 has an axial passage 166. Top surface 158 has a conical shape with a seal member 168 having an opening 170 for receiving an electrical cord. Seal 56 is formed from a flexible elastomeric polymer to be able to form a seal between the cap 30 and with the electrical cord. Seal member 168 is sufficiently thin to be flexible and elastic to deform and seal against the outer surface of the electrical cord to form a waterproof seal. In the embodiment illustrated, seal member 168 has a cylindrical sleeve 172 that is turned inwardly. Sleeve 172 in its initial inwardly extending position shown in FIG. 8 enables the electrical cord 32 to pass through the axial passage with minimal resistance. The cylindrical sleeve 172 is turned outwardly when the electrical cord passes through the axial passage in a reverse direction.

Figure 9:
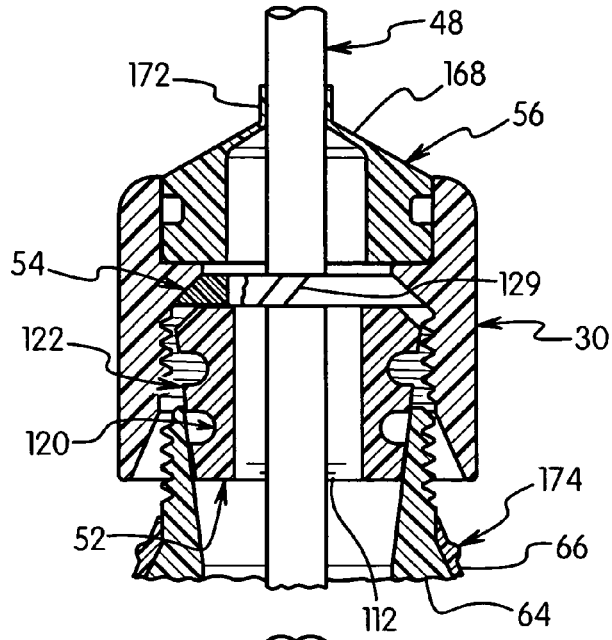
FIG. 9 is a side view in cross section of the electrical connector showing the connector during assembly.

Referring to FIG. 9, the electrical connector 12 is assembled by passing the electrical cord 32 through the axial passage of housing 16 and coupling to the electrical device such as the electrical receptacle to the electrical cord 32 and the housing 16. Typically, the bushing 52, washer 54, cap 30 and seal 56 are positioned on the electrical cord prior to connecting the electrical cord to the electrical device. Seal member 185 is fitted onto electrical cord 32 to invert sleeve 172 to an outwardly extending direction with respect to the connector and form a waterproof seal between the sleeve 172 and electrical cord 32.

Figure 10:
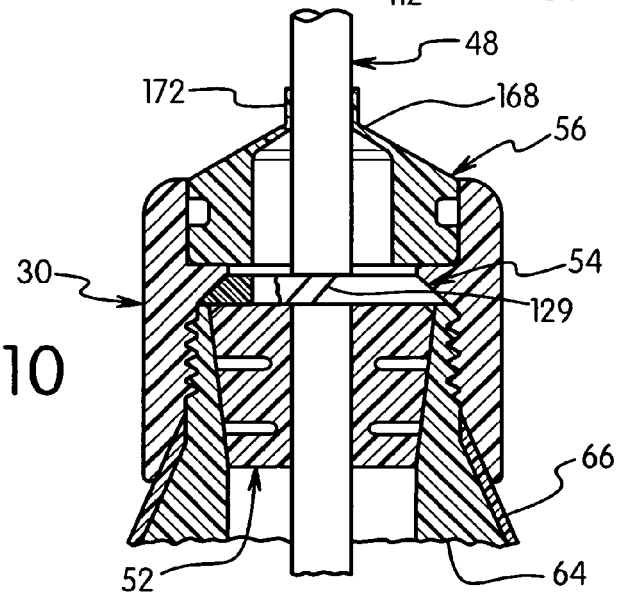
FIG. 10 is a side view in cross section of the electrical connector showing the assembled connection.

As shown in FIG. 9, the outer frustoconical surface of bushing 52 has a shape and dimension complementing the frustoconical bore 94 of body 64. In the embodiment shown, the axial passage of bushing 52 has a dimension slightly greater than the outer dimension of the electrical cord prior to assembly and in the relaxed state. Seal 56 is fitted into the recess 152 of cap 30 and retained by the tab 156 on the inner surface of cap 30. As shown in FIGS. 9 and 10, the sleeve 172, flexible seal member 168 deflects outwardly along the surface of the electrical cord to extend outwardly from the cap 30. In the embodiment shown, the washer 54 is positioned in the cap 30 with the chamfered side edge 130 mating with the inclined chamfered surface 146.

Cap 30 is threaded onto the threaded coupling 62 of housing 16 and tightened to axially and radially compress the bushing 52 onto the electrical cord. As shown in FIG. 10, the axial compression is provided by screwing the cap onto the threaded coupling with the compression washer 54 applying a substantially uniform axial force onto bushing 52. The annular recesses 116 in bushing 52 have a width and a depth to enable axial and radial compression during tightening of the cap onto the threaded coupling. As shown in FIG. 10, the annular recesses are compressed in the axial dimension of the bushing and become elongated by the axial compression in the frustoconical shaped bore of the body 64. The annular recesses enable transverse or an inwardly directed radial compression to enable the flange 112 and the inner surface of the axial passage of the bushing to form a substantially watertight continuous seal along the axial length of the electrical cord. The annular recesses also enable axial compression to form a watertight continuous seal with the axial bore of the body 64 in the surface areas between the recesses. The dimension and number of annular recesses can vary depending on the connector, the desired compression force and the flexibility of the bushing.

In one embodiment of the invention, the outer sheath 66 formed on body 64 includes an annular rib 174 formed on the frustoconical shaped collar 68. As shown in FIGS. 9 and 10, the rib 174 is aligned with the frustoconical chamfered inner edge 142 of cap 30. Rib 174 is compressible when the cap is tightened onto the threaded collar to form a waterproof seal between the bottom edge of the cap and the outer surface of the housing 16.

The electrical connector of the invention provides effective sealing of the various open areas and connections of the components to prevent water and dirt from entering the electrical connector. The cone seal 56 forms an effective waterproof seal between the electrical cord and the cap to prevent water and dirt from entering through the cap. The compressible bushing forms an effective watertight seal between the electrical cord and the axial bore of the housing. The annular rib 174 also forms a waterproof seal between the housing and the cap. The overall shape of the electrical connector provides a substantially smooth outer surface to easily shed water and dirt to maintain the integrity of the electrical connector.

The electrical connector 12 is coupled to electrical connector 14 by inserting the prongs of the electrical plug into the openings in the electrical receptacle. The end of the sleeve 76 is dimensioned to mate with a recess in the end of electrical connector 14. In one embodiment shown in FIGS. 4 and 5, electrical connector 14 has an annular recess 176 adjacent the cylindrical body 38. The recess 176 has opposing inclined side surfaces 178 and 180 and a substantially flat bottom surface 182. Recess 176 has a shape and dimension complementing the shape and dimension of the axial end of sleeve 76.

As shown in FIG. 4, electrical connector 12 is coupled to electrical connector 14 by axially sliding the ends of the connectors together. The axial end of sleeve 76 is inserted into the recess 176 of electrical connector 14. As shown in FIG. 4, the internal rib 88 of sleeve 76 contacts and deflects against the outer surface of the cylindrical body 38. In one embodiment, the inclined side sealing surfaces 178 and 180 and the bottom sealing surface 182 of recess 176 contact the complementing sealing surfaces 80, 82 and 84 of the sleeve 76 to form a waterproof seal. In addition, the annular rib 88 contacts the outer surface of the cylindrical body 38 and deflects to form a seal, and lip 86 is spaced from annular rib 50. In one embodiment of the invention, the outer surface of electrical connector 14 forms a curved end portion 184.

Figure 11:
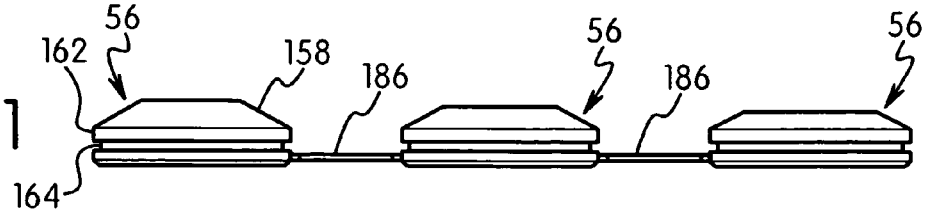
FIG. 11 is a side view of the cone seals connected together.
Figure 12:
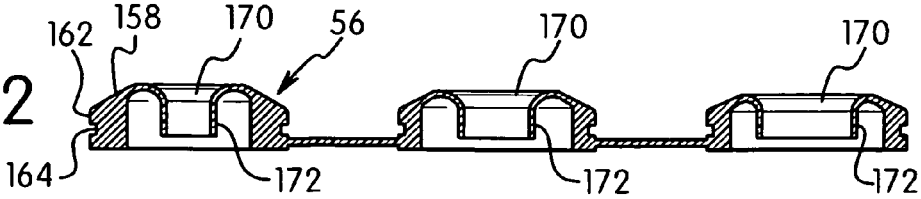
FIG. 12 is a cross-sectional view of the cone seals of FIG. 11.

In one embodiment of the invention, the electrical connectors are provided as a kit or assembly of components for accommodating different size electrical cords. The assembly can be provided with a plurality of bushings 52 and seals 56 having different size axial passages to accommodate different diameters of the electrical cord. The particular bushing and seal are selected according to the diameter or gauge of the electrical cord to provide a proper and complete seal. The bushings and the seals can be marked by suitable indicia or color coded to identify the size of the axial passage for receiving the electrical cord or cable. In one embodiment, the bushings and/or the seals can be formed by a molding process and connected together by connecting arms. As shown in FIG. 11, three seals having different dimensions of the axial passage for accommodating different gauges of electrical cord are formed as a one piece unit and connected together by arms 186. The seal is selected for the dimension of the electrical cord and separated from the arm 86.

While various embodiments have been chosen to illustrate the invention, it will be understood by those skilled in the art that various changes and modifications can be made without departing from the scope of the invention as defined in the appended claims.

What is claimed is:

1. A strained relieved cord grip assembly, comprising:

a body having a first end, a second end and an axial passage extending between said first end and said second end, said axial passage defining a frustoconical axial bore at said first end;

a compressible bushing adapted to be received in said axial bore, said bushing having a frustoconical outer surface with a shape complementing the frustoconical shape of said axial bore, said outer surface of said bushing having at least one annular groove; and a cap for coupling to said first end of said body for axially compressing said bushing and axially compressing said annular groove to form a compression seal between said bushing and said body and between said bushing and a cord, said cap having an axial passage and an annular flange extending radially into said axial passage of said cap, and a compression member positioned between said cap and said bushing to apply an axial compression against the axial end of said bushing, said compression member having a substantially flat top face, a substantially flat bottom face and a chamfered side extending between said top face and bottom face, said annular flange of said cap being positioned to mate with said compression member; wherein said annular flange being spaced from a first end a distance to define an axial recess at said first end of said cap.

2. The cord grip of claim 1, wherein said bushing has a plurality of said annular grooves, and said outer surface between said grooves forms a substantially continuous seal with said body.

3. The cord grip of claim 1, wherein said bushing has an axial passage to receive a cord extending between a first end and a second end, at least one of said ends having a flange extending inward into said axial passage for sealing against an outer surface of the cord, said axial passage of said bore forming a seal substantially the entire length of said bushing.

4. The cord grip of claim 1, wherein said cap has a first end and a second end, said axial passage extending between said first end and second end, the second end of said axial passage having internal threads for mating with said body; and said annular flange positioned between said first and second ends.

5. The cord grip of claim 4, further comprising a seal member in said axial recess of said cap, said seal member having a radial outer surface for coupling with an inner surface of said recess and an axial passage for receiving the cord;

the seal member including a frustoconical shaped top surface with an axial opening for receiving the cord, said seal having an inner edge defining said opening and for deflecting axially outward to form a seal along an axial surface of the cord.

6. The cord grip of claim 5, wherein said seal member has a cylindrical sleeve surrounding said opening.

7. The cord grip of claim 6, wherein said sleeve extends from said seal member in an inward axial direction, and where said seal member is movable to an outward axial position to form said seal along the axial surface of the cord.

8. The cord grip assembly of claim 5, wherein said seal member is seated against an outer face of said annular flange.

9. The cord grip of claim 1, wherein said body comprises a threaded coupling on an outer surface of said first end for mating with said cap;

a frustoconical collar below said thread coupling, said collar having an outwardly extending annular sealing rib for forming a substantially continuous seal between said body and said cap.

10. The cord grip of claim 9, wherein said body further comprises an inner body made of a rigid material and having a first end defining said threaded coupling, and a second end; and an outer body made of a resilient plastic material and formed on an outer surface of said inner body, said annular sealing rib being on said outer body, wherein said cap and said body define a substantially smooth outer surface.

11. The cord grip of claim 9, wherein said cap has a first end, a second end, and an axial passage, said axial passage having a frustoconical inner surface adjacent said second end for mating with said collar and sealing with said rib of said body, and said cap having internal threads for mating with said first end of said body.

12. The cord grip assembly of claim 9, wherein said cap has a first end for forming a seal against the cord and a second end having a frustoconical inner surface for mating with said frustoconical collar of said body.

13. The cord grip assembly of claim 1, wherein said cap has a first end with a flexible seal member axially spaced from said bushing, said flexible seal member having an axial passage for receiving said cord and defining an opening having a dimension less than a diameter of said cord.

14. The cord grip assembly of claim 13, further comprising a flexible sleeve extending axially from said seal around said axial passage for sealing against the cord.

15. An electrical connector having a strained relief cord grip, comprising:

a body having a frustoconical bore at a first end;

a compressible bushing received in said bore, said bushing having an outer surface with at least one annular groove;

a cap for coupling to said first end of said body for axially compressing said bushing to form a seal between said cap and body, and a seal between said bushing and an electrical cord, said cap having an axial passage extending between a first end and a second end, said first end having a recess facing axially outward and a second end for coupling to said body; and a seal member received in said recess of said cap and axially spaced from said bushing, said seal member having an outer surface for mating with said recess of said cap, an axial passage for receiving the electrical cord and a flexible frustoconical seal extending axially from said seal member, said flexible seal having an axial opening for receiving said cord and forming a seal with said electrical cord.

16. The connector of claim 15, wherein said seal member includes a cylindrical sleeve extending in said axial opening and being movable from a first inwardly extending position to an outwardly extending position to form said seal with said electrical cord.

17. The connector of claim 15, wherein said bushing has a plurality of said annular grooves, and said outer surface between said recesses of said bushing forms a substantially continuous seal with said body, said bushing and said annular grooves being axially compressible by said cap.

18. The connector of claim 15, wherein said bushing has an axial passage to receive a cord extending between a first end and a second end, at least one of said ends having a flange extending inward into said axial passage for sealing against an outer surface of the cord.

19. The connector of claim 15, further comprising a compression ring positioned between said cap and said bushing to apply an axial compression against the axial end of said bushing.

20. The connector of claim 15, wherein said cap has internal threads for mating with said body; and an annular flange extending radially into said axial passage of said cap and positioned between said first and second ends, said annular flange having a dimension to mate with said compression ring to axially compress said compression ring into contact with said bushing.

21. The connector of claim 15, wherein said body comprises a threaded coupling on an outer surface of said first end for mating with said cap;

a collar positioned below said thread coupling, said collar having an outwardly extending annular sealing rib for forming a substantially continuous seal between said body and said cap.

22. The connector of claim 21, wherein said body further comprises an inner body made of a rigid material and having a first end defining said threaded coupling, and a second end;

an outer body made of a resilient plastic material and formed on an outer surface of said inner body, said annular sealing rib being on said outer body, and where said cap and body have a substantially smooth outer surface.

23. The connector of claim 21, wherein said collar of said body has a frustoconical shape; and said cap has a first end, a second end, and an axial passage, said axial passage having a frustoconical inner surface adjacent said second end for mating with said collar; and sealing with said rib of said body, and said cap having internal threads for mating with said first end of said body.

24. The electrical connector of claim 15, wherein said cap has an annular flange extending radially inward and being spaced between said first end and second end, said annular flange having a first side cooperating with said bushing for axially compressing said bushing and a second side supporting said seal member.

25. The electrical connector of claim 24, further comprising a compression member between said first side of said annular flange and said bushing.

26. The electrical connector of claim 15, wherein said cap has a retaining member at said axial end for retaining said seal member in said recess.

27. The electrical connector of claim 26, wherein said retaining member is a tab extending inwardly from said cap into said recess and said seal member has a recess for mating with said tab.

28. An electrical connector comprising:

a first body formed from a rigid material and having a first end with a threaded coupling, a second end supporting an electrical device, and an axial passage extending between said first end and said second end, and having a frustoconical collar between said threaded coupling and said second end;

an outer sheath formed from a resilient plastic material on said body, said outer sheath having a first end overlying said collar and having a second end;

a compressible bushing with at least one annular groove adapted to be received in said axial passage of said first end of said body, said bushing having an axial passage for receiving an electrical cord; and a cap having an axial passage for receiving the electrical cord and having internal threads for coupling with said body, said cap having a first end and a second end, said second end having a frustoconical inner edge for mating with said outer sheath to define a seal between said cap and said sheath.

29. The connector of claim 28, wherein said bushing has a plurality of annular grooves on an outer surface and an outer surface between said recesses forming a substantially continuous seal with said body.

30. The connector of claim 28, wherein said bushing having a first end and a second end, at least one of said ends having a flange extending inward into said axial passage for sealing against an outer surface of the cord.

31. The connector of claim 28, further comprising a compression member positioned between said cap and said bushing to apply an axial compression against the axial end of said bushing and the cord.

32. The connector of claim 31, wherein said cap further comprises an annular flange extending radially into said axial passage and positioned between said first and second ends, said annular flange having a dimension to mate with said compression ring to axially compress said compression ring into contact with said bushing.

33. The connector of claim 28, further comprising a seal member received in an axial recess of said cap and axially spaced from said bushing, said seal member having a radial outer surface for coupling with an inner surface of said recess and an axial opening for receiving the cord;

the seal member including a sleeve encircling said axial opening for receiving the cord, said sleeve being movable from a first position extending axially inward to a second position extending axially outward to form a seal along an axial surface of the cord.

34. The connector of claim 28, wherein said first outer sheath has an annular end with an inner chamfered sealing surface, an outer chamfered sealing surface and an annular axial face, said connector further comprising:

a second body formed from a rigid material for supporting an electrical device, and a second outer sheath formed form a resilient plastic material overlying said second body, said second outer sheath having an annular recess for mating with said first outer sheath, said annular recess having inclined inner and outer sealing surfaces and a bottom sealing surface for contacting said inner and outer chamfered surfaces and axial sealing surface of said first outer sheath.

* * * * *